United States Patent [19]

Wehling et al.

[11] 4,090,210

[45] May 16, 1978

[54] SWIVEL SUPPORT FIXTURE FOR LAMP

[76] Inventors: Karl Wehling, Lignitzer Str. 9; Karlheinz Brechelt, Leipziger Str. 4, both of 492 Lemgo, Germany

[21] Appl. No.: 624,094

[22] Filed: Oct. 20, 1975

[30] Foreign Application Priority Data

Oct. 19, 1974 Germany ..... 2449721

[51] Int. Cl.[2] ..... F21S 1/12

[52] U.S. Cl. ..... 362/419; 248/278

[58] Field of Search ..... 248/278, 279, 280; 240/73 R, 73 BA, 73 BJ, 78 R, 78 B, 81 R, 81 BD, 81 BE

[56] References Cited

U.S. PATENT DOCUMENTS

| | | | |
|---|---|---|---|
| 1,097,588 | 5/1914 | Jackson | 248/278 |
| 1,412,544 | 4/1922 | Shirreffs | 248/278 |
| 1,424,687 | 8/1922 | Stearns | 248/278 |
| 1,430,135 | 9/1922 | Williams | 248/278 |
| 1,438,534 | 12/1922 | Kuen | 248/278 |
| 1,459,856 | 6/1923 | Otte | 248/278 |
| 1,520,894 | 12/1924 | Thomas | 248/278 |
| 1,548,620 | 8/1925 | Lollis | 248/278 |
| 1,580,316 | 4/1926 | Moreton | 248/278 |
| 2,709,097 | 4/1955 | Leary | 248/278 |
| 2,914,829 | 12/1959 | Willemain | 248/278 |

*Primary Examiner*—L. T. Hix
*Assistant Examiner*—Alan Mathews
*Attorney, Agent, or Firm*—Pollock, Vande Sande & Priddy

[57] ABSTRACT

A swivel-and-tilt type support fixture for an electric lamp. An elongate tubular conduit member, rigidly supported on an electrical junction box, has an L-shaped member whose one leg is rotatably supported thereon at one end. A friction joint is provided between the L-shaped member and the conduit member so that the L-shaped member can be rotated or swiveled to a predetermined position about the axis of the conduit member. A third member is supported for rotation relative to the other leg of the L-shaped member so that said third member rotates or tilts about an axis which is at a right angle to the axis of the conduit member. The lamp and an associated hood therefor are detachably connected to the third member.

6 Claims, 4 Drawing Figures

SWIVEL SUPPORT FIXTURE FOR LAMP

BACKGROUND OF THE INVENTION

The invention relates to a swivel-and-tilt type holder for an electric lamp.

It is known in the art to provide a swivel-and-tilt type lamp holder which is provided with a sleeve which is rotatably mounted upon the end of a tubular bracket, and with a rod supported within the sleeve and capable of being rotated about an axis vertical to the axis of sleeve rotation. In such a lamp holder, the rod is screwed into the rear end of a standard lamp holder, and the holder as well as the joint are then surrounded by a clamped-on cylindrical tube.

A principal disadvantage of the prior art type of lamp holder is the complexity of construction of the joint mechanism since the several components of the joint must then be manufactured to quite close tolerances. Failure to observe close tolerances causes premature wear at the joint with the result that insufficient positive coupling of the parts results so that the lamp will not maintain a preset position but will move therefrom as a result of its own weight.

SUMMARY OF THE INVENTION

It is an object of the invention to provide a swivel-and-tilt type lamp holder which can be manufactured from simple structural components and still function in a highly reliable manner. According to the invention, a first conduit member is provided which is detachably connected to an electrical junction box or the like. A second L-shaped member has one leg thereof supported for rotation on one end of the conduit member in a manner to permit said second member to rotate about the axis of the conduit member. A third member is rotatably joined by a pivot means to the other leg of the second member so that it can rotate relative to said second member about an axis which is perpendicular to the longitudinal axis of the conduit member. Both of the rotatable joints, i.e., the joint between the conduit member and said second member and between said second member and said third member comprise frictional joints so that the parts joined thereby, when moved to a predetermined position, tend to remain in that position until readjusted. According to a preferred embodiment, the rotatable joints each include a spring-type compression retaining member which can frictionally securely grip a shaft, bolt, or the like, and with the peripheral portion thereof exerting pressure on one of the two parts forming the joint. The use of such rotatable joints in connection with a lamp holder is known in the prior art as, for example, in West German Gebrauchsmuster No. 1,986,077.

The present invention makes it possible to provide a swivel and tilt joint for a lamp or the like which functions in an absolutely reliable manner and which can be swiveled by 360° and tilted by 90°, and yet requires only a few inexpensive and, in part, standard components. It is, moreover, readily possible to assemble the apparatus of the invention so as to provide a predetermined amount of frictional resistance to turning at each of the pivots so that the desired degree of frictional forces are available to hold the lamp safely in place in a preset position while also permitting easy adjustment to a desired position.

BRIEF DESCRIPTION OF THE DRAWINGS

In describing the invention, reference will be made to the accompanying drawings in which.

DETAILED DESCRIPTION OF THE PREFERRED EMBODIMENT

Figure 1:
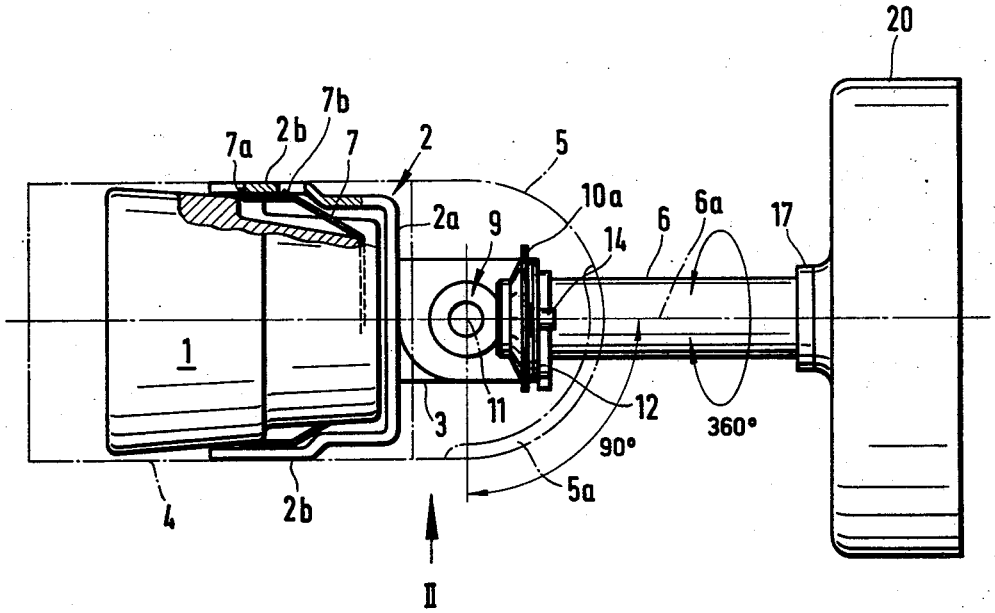
FIG. 1 illustrates a side view of the apparatus of the invention.
Figure 2:
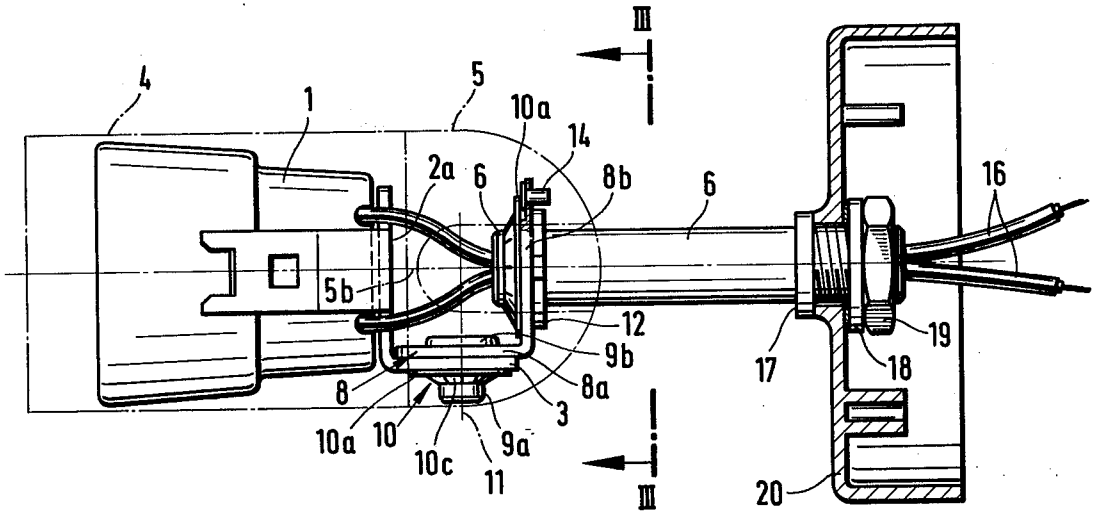
FIG. 2 is a top view of the apparatus of FIG. 1.

The swivel-and-tilt lamp holder mechanism of FIGS. 1 and 2 is shown as including a U-shaped cross member 2. Integrally formed with the U-shaped cross member 2 is a plate portion 3 which forms an angle of 90° relative to the bight portion **2*a* of member 2. The opposing leg portions 2*b* of member 2 are resiliently supported on the portion 2*a* thereof and are so configured that they effectively surround the lamp holder 1**.

The sides **2*b* of cross member 2 form a support for a covering sleeve 4 which has the form of a generally cylindrical tube and is shown in dotted line in FIGS. 1 and 2. Such covering sleeve extends in the form of a hood 5 which is generally of hemispherical configuration at one end thereof but with the leftward extension thereof in FIGS. 1 and 2 being of cylindrical configuration. As will become apparent from the description which follows, the member 2 is capable of being rotated counterclockwise by as much as 90° relative to the conduit 6, and for this reason the hood portion 5 is provided with a slot 5*a* to permit such rotation of the hood 5 without interference between the hood and conduit member 6**.

The lamp holder 1 can be detachably secured to the cross member 2 either by being screwed thereto or by means of a stop spring 7 shown in FIG. 1. Such stop spring is fastened to the holder 1 and engages with a shoulder **7*a* and an aperture 7*b* formed in the portion 2*b* of the cross member 2 when the holder 1 is inserted between the parts 2*b* of member 2**.

Figure 4:
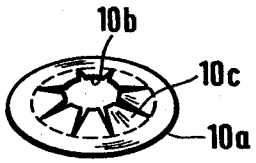
FIG. 4 is a perspective view of one of the components used in providing the preferred type of pivotal lock.

Plate 3 is swivel-mounted to a first leg **8*a* of an L-shaped member 8 by means of an attachment pin 9 and a pivot lock member 10. Such pivot lock member 10 is shown in perspective view in FIG. 4. The pivot lock 10 fits snugly with its circular contact face 10*a* abutting the outer surface of plate 3 and with the end portions 10*b* of its radially inwardly directed portions 10*c* bearing against the neck 9*a* of an attachment pin 9. The head 9*b* of such attachment pin is placed at the inside of leg 8*a* of the L-shaped member 8. During assembly, the pivot lock 10 and the attachment pin 9 are forced together. The force of the contact pressure of the first side 8*a* against the plate 3, and thus the frictional resistance of the pivot are influenced by the extent to which the plates 10*c* are moved in the direction of the head 9*b* of attachment pin 9** at the time of assembly.

The other leg **8*b* of the L-shaped member 8 is secured to conduit member 6 by means of a second pivot lock 10 in a similar manner. In this instance, the leg 8*b* of member 8 is placed onto the neck 12 of conduit member 6. The circular contact face 10*a* of the pivot lock member 10 fits snugly against the inside of the leg 8*b*, and the portions 10*c* of member 10 rest with their internal end surfaces 10b abutting the circumferential end portion of the conduit member 6**.

Figure 3:
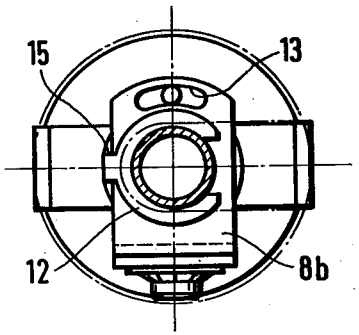
FIG. 3 is a sectional view taken along the section line III—III of FIG. 2.

The leg portion 8b of L-shaped member 8 is provided with an arcuate slot 13, and a headed pin 14 is freely slidable within the slot, the head of the pin being resiliently restrained between contact face 10a and leg 8b. A collar member 12 secured to conduit 6 is provided with a projecting portion 15 as shown in FIG. 3. Accordingly, as the leg portion 8b of member 8 rotates relative to conduit 6, such projection 15 will abut pin 14 to prevent further rotation. Thus, pin 14 acts as a stop limit to permit rotation of member 8 relative to collar 6 to an extent of about 360°. The ability of the pin 14 to travel freely in the slot formed in the leg 8b of L-shaped member 8 ensures that a full 360° of rotation between these two members can be accomplished while nevertheless preventing rotation in excess of a full revolution.

Electric wires 16 extend from junction box 20 through the hollow interior of conduit 6, and conduit 6 is secured to the junction box 20 by means of flange member 17, washer 18, and lock nut 19.

At the end of the slot 5a of the covering hood a parting joint 5b is provided. This makes it possible to assemble the several parts which comprise the swivel and tilt joint and then subsequently to place into position the covering hood and covering sleeve. The covering hood is attached by separating it at the parting joint 5b until its internal diameter has increased sufficiently to permit it to slide over the several parts comprising the joint.

In a preferred embodiment, it has been found desirable to form the U-shaped member 2 and the L-shaped member 8 of dissimilar metals such as brass and iron, since this provides smoother rotation at the respective joints. Also, it is preferable to provide washers between the parts which move relatively to each other so as to control the frictional force.

What we claim is:

1. A swivel and tilt mechanism for support of a lamp, comprising:

a fixed conduit member through which electric wires for said lamp may be conducted, said conduit member having a collar member near one end thereof;

a generally L-shaped unitary member having one leg with an aperture rotatably surrounding said conduit member for rotation about the axis of said conduit member, said L-shaped member being frictionally engaged on one side of said one leg by a lock member which also frictionally engages said conduit member and on the other side of said one leg by said collar member, said lock member comprising a generally cup-shaped portion with a central aperture and a plurality of radial slits extending part way outwardly from said central aperture to provide thereby a plurality of resilient, inwardly directed fingers whose inner ends frictionally engage the outer circumference of said conduit member to force said L-shaped member and said collar into frictional engagement whereby said L-shaped member may be adjustably positioned relative to said conduit member;

a support member having an aperture alignable with an aperture formed in a second leg of said L-shaped member;

a pivot pin extending through said aligned apertures allowing rotation of said support member about a second axis perpendicular to said axis of said conduit member, and a further lock member which frictionally engages said support member and said pivot pin, said further lock member comprising a further generally cup-shaped portion with a central aperture and a plurality of radial slots extending part way outwardly from said central aperture to provide thereby a further plurality of resilient, inwardly directed fingers whose inner ends frictionally engage the outer circumference of said pivot pin to force said support member and said second leg into frictional engagement whereby said support member may be adjustably positioned relative to said second leg;

a hood member detachably connected to said support member; and stop means for limiting the extent of rotation of said L-shaped member relative to said conduit member.

2. The apparatus of claim 1, wherein said support member includes a generally U-shaped portion and is rotatable about said second axis, with at least one of the legs of said U-shaped portion releasably engaging said hood member.

3. A swivel and tilt mechanism for support of a lamp, comprising:

a fixed conduit member through which electric wires for said lamp may be conducted;

a generally L-shaped member having one leg rotatably supported on an end of said conduit member for rotation about the axis of said conduit member;

a support member rotatably supported on a second leg of said L-shaped member for rotation about a second axis perpendicular to the axis of said conduit member;

a hood member detachably connected to said support member;

an arcuate slot in said one leg of said L-shaped member;

a pin slidably mounted in said slot; and a protuberance fixed on said conduit member in position to abut said pin as said L-shaped member is rotated, whereby said pin may move to one end of said slot upon contact with said protuberance during rotation of said L-shaped member in one direction, and to the other end of said slot upon contact with said protuberance during rotation of said L-shaped member in the opposite direction, thereby permitting full 360° rotation of said L-shaped member about the axis of said conduit member, but preventing excessive rotation.

4. The apparatus of claim 3, wherein said support member includes a generally U-shaped portion and is rotatable about said second axis, with at least one of the legs of said U-shaped portion releasably engaging said hood member.

5. A swivel and tilt mechanism for support of a lamp, comprising:

a fixed conduit member through which electric wires for said lamp may be conducted;

a generally L-shaped member having one leg rotatably supported on an end of said conduit member for rotation about the axis of said conduit member;

a support member rotatably supported on a second leg of said L-shaped member for rotation about a second axis perpendicular to the axis of said conduit member;

a hood member detachably connected to said support member, said hood member comprising a substantially closed end portion surrounding said support member and said L-shaped member, and a slot in the wall of said end portion positioned to receive said conduit member as said support member is rotated on said L-shaped member, thereby permitting full 90° rotation of said support member.

6. The apparatus of claim 5, wherein said support member includes a generally U-shaped portion and is rotatable about said second axis, with at least one of the legs of said U-shaped portion releasably engaging said hood member.

* * * * *